United States Patent [19]

Lee

[11] Patent Number: 5,004,950

[45] Date of Patent: Apr. 2, 1991

[54] PLASMA DISPLAY PANEL ARRANGED WITH AUXILIARY ELECTRODE

[75] Inventor: Seung-Woo Lee, Seoul, Rep. of Korea

[73] Assignee: Samsung Electron Devices Co., Ltd., Kyonggi, Rep. of Korea

[21] Appl. No.: 403,345

[22] Filed: Sep. 6, 1989

[30] Foreign Application Priority Data

Sep. 16, 1988 [KR] Rep. of Korea ..... 88-15299

[51] Int. Cl.[5] ..... H01J 17/49

[52] U.S. Cl. ..... 313/582; 313/584

[58] Field of Search ..... 313/582, 584, 585

[56] References Cited

U.S. PATENT DOCUMENTS 3,735,183 5/1973 Walters ..... 313/584 X
3,885,195 5/1975 Amano ..... 315/169 TV
3,899,707 8/1975 Sasaki et al. ..... 313/582

FOREIGN PATENT DOCUMENTS 53-25474 7/1978 Japan .
150524 11/1980 Japan ..... 313/582

*Primary Examiner*—Sandra L. O'Shea
*Attorney, Agent, or Firm*—Flynn, Thiel, Boutell & Tanis

[57] ABSTRACT

A plasma display panel arranged with a sub-electrode within the interior of a barrier rib for improving the structure which produces the priming particle. The invention is characterized in that the sub-electrode is formed within the interior of the barrier rib so that sputtering of the charged particles generated during the main discharge is reduced. According to the invention, damage to the primary electrodes can be prevented, and the spatial structure of the cell is simplified so that the quality of the visual display is improved.

4 Claims, 1 Drawing Sheet

PLASMA DISPLAY PANEL ARRANGED WITH AUXILIARY ELECTRODE

BACKGROUND OF THE INVENTION

The present invention relates to a plasma display panel arranged with an auxiliary electrode, and more particularly, to a plasma display panel which is arranged with auxiliary electrodes within respective barrier ribs and which reduces the sputtering effect damage to the cathode electrode by deflecting positive ions within a cell of the display panel according to step pulses applied to the auxiliary electrodes, so that the structure for producing priming particles is improved without the spatial requirements of conventional special priming devices.

In general, the plasma display panel (hereinafter PDP) is a display element in which inert gas is introduced and sealed between two glass substrates formed with respective electrodes and utilizing the gas discharge produced by voltages applied to both electrodes.

Japanese Laid Open Patent Publication No. Sho-53-25474 is related to a discharge type displaying panel, which is structured such that two glass substrates are supported with a predetermined distance or gap therebetween and are sealed together air tight by a frit seal. The panel includes a first electrode array consisting of a plurality of parallel cathode electrode bands extending in one direction and formed on the interior surface of one of the substrates. A second electrode array consisting of a plurality of parallel electrodes extending in a direction which crosses the extending direction of said first electrode array is formed on the interior surface of the other substrate, and a gas is introduced into the sealed gap between both substrates.

In the display panel having this structure, a predetermined negative voltage required for discharge is applied in sequential time sharing to the electrodes of the first electrode array, and a potential corresponding to the display signal is applied sequentially or simultaneously to the electrodes of the second electrode array. A luminous discharge occurs at crossing points of the first and second electrode arrays in spot sequential or in line sequential. The luminant display is a visual picture of a pattern corresponding to the display signal. In this case, the glow extends along the cathode having negative potential due to the diffusion of ionized electrons, and there has been a disadvantage in that this cross talk occurs.

This conventional PDP structure is shown in FIG. 1. The cathode array 4 is formed on the surface of the rear glass substrate 5, anode array 2 includes transparent conductive film electrodes which are formed on the surface of the front glass substrate 1 with a predetermined distance therebetween. The two glass substrates 1, 5 are opposed to one another, and barrier ribs 3 are formed between the cathode electrodes 4.

In this PDP structure, the auxiliary electrodes 6 are set within the cell so that priming particles are produced thereby and an auxiliary discharge occurs in the cell before starting the main discharge. There has been a disadvantage in that the structure within the cell space is complicated owing to the double structure of the cell space, i.e., the structure of the priming auxiliary electrode 6 in addition to the anode 2 of the cell.

Further, since the PDP structure is DC type, there is no operation to define the positive ions produced upon the main gas discharge. Accordingly, the cathode 4 is damaged due to the sputtering effect produced by these positive ions, and therefore, there has been a disadvantage in that the operable life of the panel is shortened.

In conventional PDP structure (FIG. 1), an auxiliary electrode 6 is separately provided within each cell in order to produce the priming particles and auxiliary discharge before the main gas discharge pulse occurs. Ionized particles produced from the auxiliary electrodes are used as priming particles.

Therefore, it is an object of the present invention to provide a plasma display panel arranged with auxiliary electrodes for simplifying the PDP structure according to the location of the auxiliary electrodes and for, at the same time, defining the positive ions produced during the main gas discharge and preventing damage to the electrode.

In order to accomplish these objects, the present invention is characterized in that the auxiliary electrodes for positive ion control and priming particle generation are arranged within the interior of the barrier ribs.

The foregoing and other objects as well as advantages of the present invention will become clear from the following description of the invention with reference to the accompanying drawings.

BRIEF DESCRIPTION OF THE DRAWINGS

For a better understanding of the invention, and to show how the same may be carried into effect, reference will now be made, by way of example, to the accompanying drawings, in which:

FIGS. 3*a* and 3*b* illustrate voltage waveforms which are respectively applied to alternate ones of the auxiliary electrodes to cause the auxiliary discharge.

Throughout the drawings, like reference numerals and symbols are used for designating like or equivalent parts or portions, for simplicity of illustration and explanation.

DETAILED DESCRIPTION OF THE PREFERRED EMBODIMENT

Hereinafter, a preferred embodiment of the present invention will be described in detail with reference to the accompanying drawings.

Figure 1:
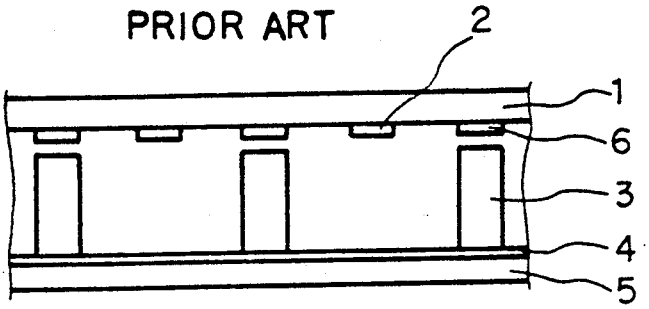
FIG 1 PRIOR ART
FIG. 1 is a cross sectional view for illustrating the structure of a conventional plasma display panel.
Figure 2:
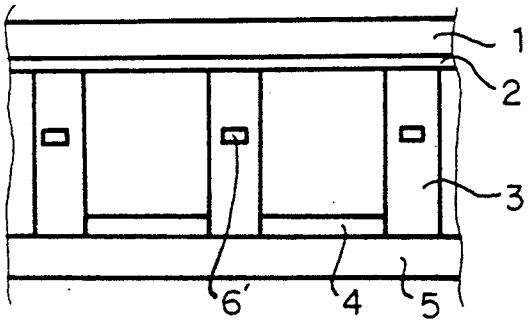
FIG. 2 is a cross sectional view for illustrating a plasma display panel of a preferred embodiment of the present invention.

FIG. 2 is a cross sectional view showing the structure of the plasma display panel of a preferred embodiment of the present invention, wherein a special feature of the PDP structure according to the present invention is that the priming auxiliary electrodes 6 are not arranged on the surface of the front substrate 1 as shown in prior art FIG. 1, but rather are formed within the interior of the barrier ribs 3 as shown in FIG. 2. Hereinafter, the auxiliary electrodes formed within the interior of the barrier ribs 3 are designated as 6'.

In the PDP structure of the present invention, since the auxiliary electrodes 6' are formed within the interior of the barrier ribs of predetermined height, the spatial structure of each cell is simple, and the positive ions generated during the main gas discharge tend to move past the auxiliary electrodes 6' located at the intermediate height of the cell.

The priming particles are produced, even if the main discharge is not induced within the cell, by a square wave pulse of pertinent frequency and amplitude applied to the auxiliary electrodes 6'. At the same time, the positive ion can be defined.

Figure 3:
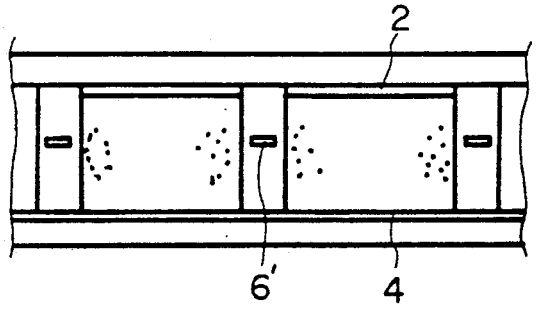
FIG. 3 is a cross sectional view for illustrating a step of auxiliary discharge induced with charged particles according to the present invention.
Figure 3:
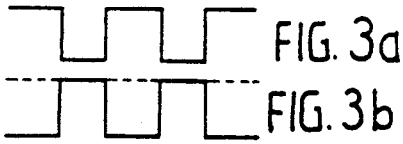

FIG. 3 is a diagram for showing the auxiliary discharge step induced upon the generation of the charged priming particles, wherein a small discharge is made by applying a weak discharge starting alternating current voltage to the auxiliary electrodes 6' before the main discharge is generated, so that the main discharge can be easily generated.

Figure 4:
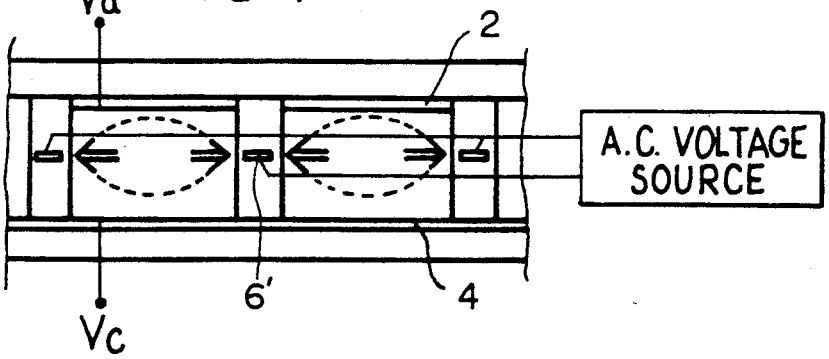
FIG. 4 is a cross sectional view for showing a main discharge step wherein the charged particles are induced in the horizontal direction according to the present invention.

At this moment, when applying the weak alternating current voltage, the waveforms of FIGS. 3*a* and 3*b* from the AC voltage source of FIG. 4 are respectively applied to alternate ones of the auxiliary electrodes 6'.

FIG. 4 is a diagram for showing the main discharge step generated after the auxiliary discharge.

When the voltages Va and Vc (FIG. 4) are applied to the anode 2 and cathode 4, the main discharge begins wherein the charged particles are generated with strength between the anode 2 and cathode 4 by the electric effect, and move strongly to strike the cathode.

However, at this moment, the weak AC discharge starting voltage is still being applied to the auxiliary electrodes 6' of the present invention, and the sputtering phenomenon generated during this main discharge is reduced due to an electric field which extends horizontally between the auxiliary electrodes 6'. That is, the electric field between the auxiliary electrodes 6' exerts a force on the charged particles generated between the anode 2 and cathode 4, which force acts in the horizontal direction. Thus, the force of the charged particles vertically striking the cathode 4 is reduced, and the damage to the cathode 4 can be prevented.

As described above, according to the present invention, it is possible to influence the motion of the positive ions generated by the gas discharge of the PDP at the intermediate height of the cell and thereby prevent the damage to the cathode electrode associated with the sputtering operation of the prior art. Also, the spatial structure of the interior of the PDP cell is simplified by forming the auxiliary electrode within the interior of the barrier rib, and the quality of the visual display is improved because the voltage according to the auxiliary discharge being decreased, accordingly the discharge starting voltage being increased.

It will be appreciated that the present invention is not restricted to the particular embodiment that has been described hereinbefore, and that variations and modifications may be made therein without departing from the spirit and scope of the invention as defined in the appended claims and equivalents thereof.

I claim:

1. In a plasma display panel having front and rear substrates supported in spaced relationship from each other to define a gap therebetween, said substrates having opposed surfaces which face each other across said gap, an anode and a cathode formed respectively on said substrate surfaces, means for creating a seal between said substrates so that said gap is sealed, a quantity of gas confined in said sealed gap, means for effecting a voltage differential between said anode and said cathode which is sufficient to cause movement of ions in a first direction across said gap from said anode to said cathode, and auxiliary electrode means disposed in said gap for permitting introduction of priming ions into said gap before said voltage differential is effected between said anode and said cathode, the improvement comprising:

means operable while said voltage differential exists between said anode and said cathode for producing in said gap an electric field which forcibly urges ions in said gap in a second direction approximately perpendicular to said first direction, said electric field producing means including means for applying an AC voltage to said auxiliary electrode means while said voltage differential exists between said anode and said cathode.

2. A device according to claim 1, wherein said auxiliary electrode means includes a pair of auxiliary electrodes, a pair of barrier ribs positioned in said gap between said anode and said cathode and spaced from each other in said second direction, each said barrier rib having one of said auxiliary electrodes enclosed therein, said auxiliary electrodes being spaced generally intermediately between said substrates, and said AC voltage applying means including means for maintaining a generally constant voltage differential of periodically alternating polarity between said auxiliary electrodes.

3. The device according to claim 2, wherein said means for maintaining said constant voltage differential between said auxiliary electrodes includes first means for applying a first AC voltage waveform to one of said auxiliary electrodes and second means for applying to the other of said auxiliary electrodes a second AC voltage waveform which is approximately equal to said first AC voltage waveform in frequency and magnitude but which is out of phase therewith by approximately one-half cycle.

4. A device according to claim 3, wherein said substrates are glass, said anode being formed on said front substrate and said cathode being formed on said rear substrate.

* * * * *